United States Patent [19]

Hynšt

[11] 4,050,383

[45] Sept. 27, 1977

[54] ARRANGEMENT FOR GENERATING A ROCKING MOTION OF A TRANSFER CYLINDER OF AN INKING SYSTEM

[75] Inventor: Karel Hynšt, Adamov, Czechoslovakia

[73] Assignee: Adamovske strojirny, narodni podnik, Adamov, Czechoslovakia

[21] Appl. No.: 696,636

[22] Filed: June 16, 1976

[30] Foreign Application Priority Data

June 23, 1975 Czechoslovakia ..... 4403/75

[51] Int. Cl.[2] ..... B41F 31/14

[52] U.S. Cl. ..... 101/349; 101/DIG. 6

[58] Field of Search ..... 101/DIG. 6, 349, 350, 101/351, 352, 206, 207

[56] References Cited

U.S. PATENT DOCUMENTS

| | | | |
|---|---|---|---|
| 956,316 | 4/1910 | Droitcour | 101/DIG. 6 |
| 967,906 | 8/1910 | Halliwell | 101/350 |
| 2,950,677 | 8/1960 | Staley | 101/350 |

*Primary Examiner*—J. Reed Fisher

*Attorney, Agent, or Firm*—Burgess, Ryan and Wayne

[57] ABSTRACT

The rocking motion of the transfer cylinder of an inking system of printing machines is derived in dependence on the turning of the ductor cylinder by a couple of cams, one of which is fixed, the other adjustable, by means of ratchet wheels and pawls, adjusting thereby the magnitude of turning of the ductor cylinder and thus also the length of mutual contact of the ductor cylinder with the transfer cylinder.

4 Claims, 3 Drawing Figures

ARRANGEMENT FOR GENERATING A ROCKING MOTION OF A TRANSFER CYLINDER OF AN INKING SYSTEM

BACKGROUND OF THE INVENTION

Object of this invention is an arrangement for generating a rocking motion of a transfer cylinder of an inking system, particularly for offset printing machines.

The task of a similar arrangement is to provide a transfer cylinder of an inking system, an intermittent motion related to an intermittent motion of the ductor cylinder.

The rotating ductor cylinder collects on its surface printing ink from a storage device and a uniform layer of printing ink is created on its surface by an adjustable doctor blade. The printing ink is taken over by the transfer cylinder and transmitted to the cylinders of the inking system.

Actually known arrangements have the rocking motion of the transfer cylinder derived from the rotating motion of the ductor cylinder, which motion may be either continuous or intermittent. The amount of printing ink taken over by the transfer cylinder is for arrangements with continuous rotating motion of the ductor cylinder dependent on the length of track of the mutual contact of both cylinders. In arrangements with intermittent rotating motion of the ductor cylinder, the amount of ink taken over by the transfer cylinder is controlled by the angular displacement of the ductor cylinder and can be equally adjusted.

In arrangements where the ductor cylinder performs a continuous rotating motion, the rocking motion of the transfer cylinder is obtained by a cam, receiving its drive from the ductor cylinder. This cam is in constant contact with an eccentrically arranged lever controlling the mechanism of the transfer cylinder. The length of track of the mutual rolling contact of the transfer cylinder and the ductor cylinder is adjustable by changing the position of an eccentric bolt of this lever.

A drawback of this arrangement is that at a continuous rotation of the ductor cylinder dirt and dust from the paper are with higher intensity introduced into the ink of the ink storage device, influencing unfavorably the adjustment of thickness of the ink layer on the ductor cylinder.

Other known arrangements where the ductor cylinder performs an intermittent motion are provided with a cam on the driving chain wheel, with a roller, supported rotatably on a two arm lever, contacting this cam. The two arm lever transmits to the transfer cylinder the rocking motion. The length of track of the mutual rolling contact of the transfer cylinder and the ductor cylinder cannot be adjusted in this arrangement. It is only possible to adjust the magnitude of the angular displacement of the ductor cylinder.

A drawback of this arrangement is that the rocking motion of the transfer cylinder is derived from a cam and cannot be adjusted, whereby similar arrangements are complicated.

SUMMAY OF THE INVENTION

It is an object of this invention to provide a drive of a rocking transfer cylinder, where the length of the track of mutual contact of the transfer cylinder and the ductor cylinder could be easily adjusted by using a simple and effective construction.

According to this invention a first and second pawl are by means of a connecting bolt in rocking fashion supported on a chain wheel, which in turn is rotatably supported on the shaft of the ductor cylinder, the first pawl having a thumb, resting alternatively on the working track of an adjustable cam, rotatably supported on a supporting sleeve and on the working track of a stable cam. The first pawl engages with a first ratchet wheel fixed on the shaft of the ductor cylinder and the second pawl engages with a second ratchet wheel, rotatably supported on the shaft of the ductor cylinder, the second ratchet wheel having a cam track on its hub, with a roller, arranged on a first control lever contacting this tract. The lever is pivotably supported on a supporting bolt and connected by connecting bolts and by a rod with a second control lever. The second control lever is fastened on a supporting rod, on which a return lever is fixed, on which a second pull spring is suspended, the other end of which spring is fastened on the side wall of the printing machine. A stop bolt is fixed on the hub of the second ratchet wheel, with which bolt a spring loaded stop is cooperating, fixed on the side wall of the printing machine, a first pull spring being fixed with one end on the hub of the first ratchet wheel, the other end of this spring being fastened on the side wall of the printing machine.

An advantage of this invention is, that the contact of the transfer cylinder with the ductor cylinder is solely accomplished, if the ductor cylinder is turning, whereby the adjustment of the length of the track of the rolling contact of both said cylinders and the proper adjustment of turning of the ductor cylinder is unified to a single operation, whereby only the angle of turning of the ductor cylinder is adjusted, the proper construction being thereby simultaneously simple.

DESCRIPTION OF DRAWINGS

One of possible solutions is schematically indicated on the attached drawings, where.

DESCRIPTION OF PREFERRED EMBODIMENT

Figure 1:
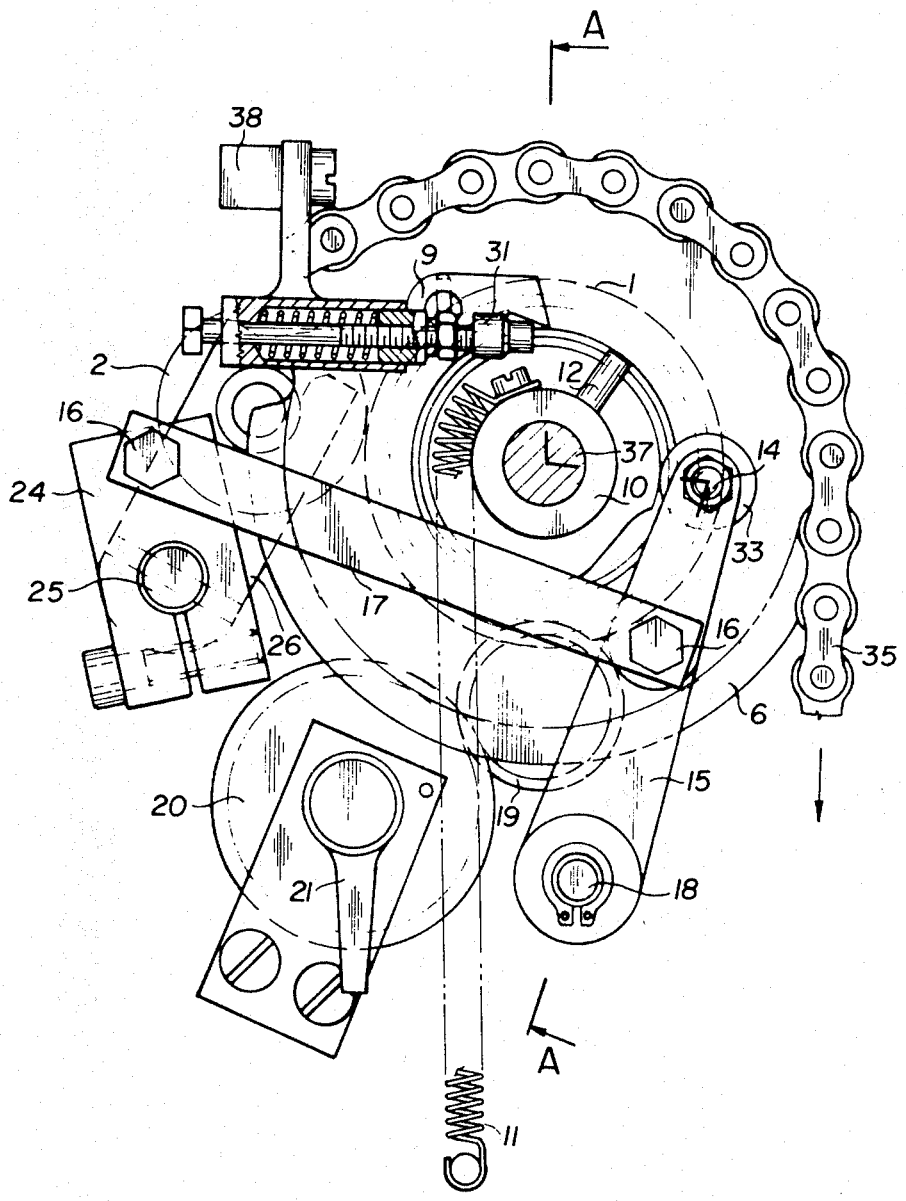
FIG. 1 is an arrangement in side view.
Figure 2:
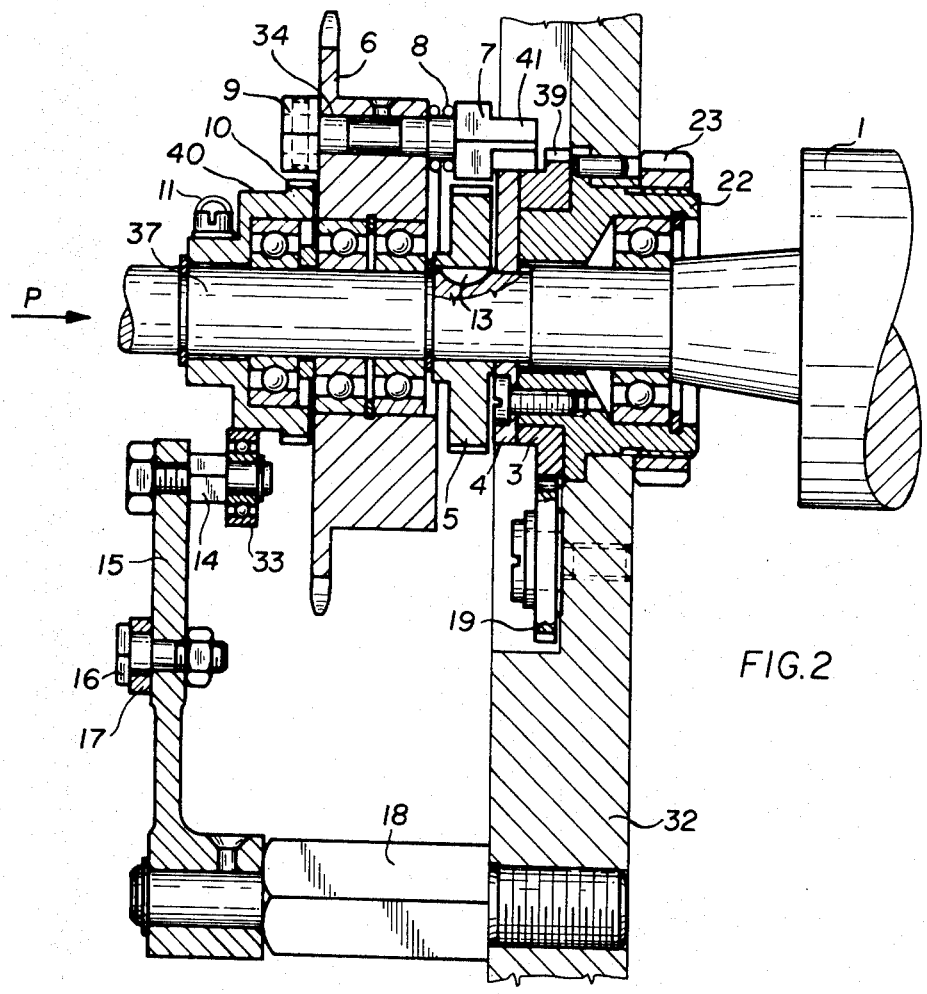
FIG. 2 the same arrangement in partial section taken along a plane indicated in FIG. 1 by A—A.
Figure 3:
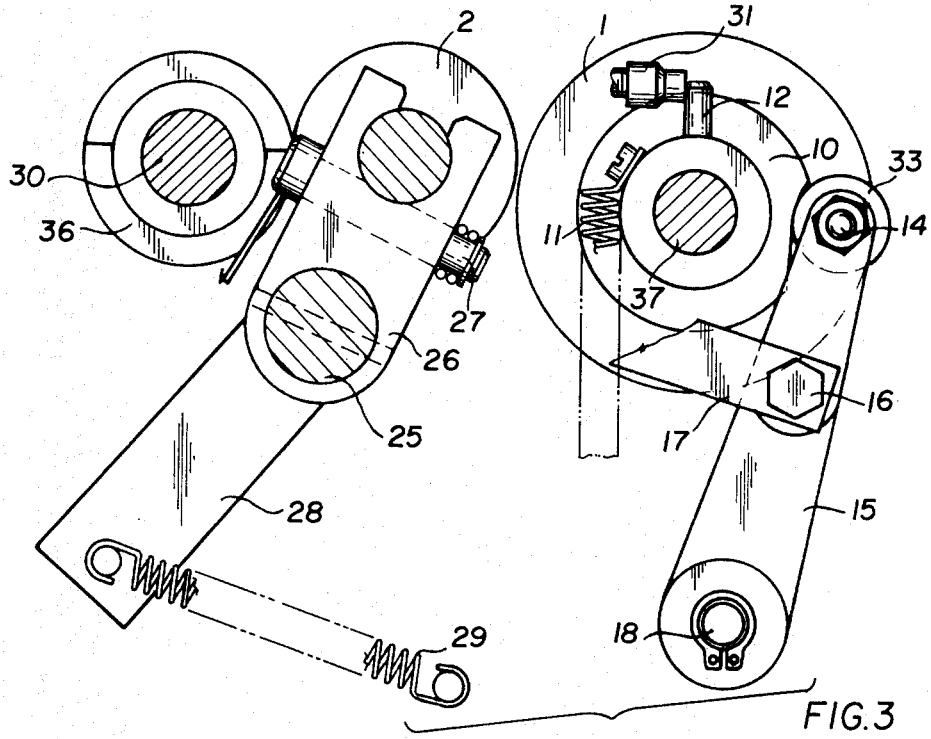
FIG. 3 a partial view in direction of the arrow "P" from FIG. 2 in a partial section.

The arrangement comprises a ductor cylinder 1, rotatably supported by its shaft 37 in a bearing of a supporting sleeve 22. The supporting sleeve 22, which secures the ductor cylinder 1 from axial shifting is fixed to the side wall 32 of the printing machine and is secured by a safety nut 23. A first ratchet wheel 5 is fixed by a key 13 on the shaft 37 of the ductor cylinder 1, with a first pawl 7 engaging therewith, urged into engagement by a torsion spring 8. The first pawl 7 is pivotably supported on the hub of a chain wheel 6 and is provided with a thumb 41. The thumb 41 of the first pawl 7 rests alternately on the working track of an adjustable cam 3. The stable cam 4 is fixed by means of screws on the supporting sleeve 22. The adjustable cam 3 is provided with an indentment 39 and is rotatably supported on the hub of the supporting sleeve 22. The detent 39 of the adjustable cam 3 meshes in an intermediate toothed wheel 19, which in turn meshes with a toothed control wheel 20 which is firmly connected to a control lever 21. The first pawl 7 is firmly connected by means of the connecting bolt 34 with the second pawl 9, the connecting bolt 34 being rotatably supported in the hub of the chain wheel 6. The chain wheel 6 is driven by a chain 35 from a drive (not shown). The second pawl 9 engages with the second ratchet wheel 10, which is rotatably supported on the shaft 37 of the ductor cylinder 1. A first pull spring 11 is suspended with one end on the hub of the second ratchet wheel 10, the other end of which being fixed on the side wall 32 of the printing machine. The second ratchet wheel 10 is in its starting position secured by a springing stop 31, bearing against a stop bolt 12, fixed in the hub of the second ratchet wheel 10. The springing stop 31 is supported in a holder 38, fixed to the side wall 32 of the printing machine. A cam track is formed on the hub of the second ratchet wheel 10, with a roller 33 rotatably supported on a bolt 14, fixed on the first control lever 15 bearing against this cam track 40. The first control lever 15 is swingably supported on a supporting bolt 18 fixed on the side wall 32 of the printing machine. The first control lever 15 is by means of connecting bolts 16 and a rod 17 connected with a second control lever 24. The second control lever 24 is fixed on a supporting rod 25 where also a return lever 28 is fixed. A second pull spring 29 is suspended with one end on the return lever 28, the second end thereof being fixed on the side wall 32 of the printing machine. The supporting rod 25 is rotatably supported in the side wall 32 of the printing machine, holders 26 being fixed on this supporting rod 25, supporting the transfer cylinder 2, secured against shifting by a pin 27. The transfer cylinder 2 contacts the inking cylinder 30, which itself is rotatably supported by sleeves 36 fixed on the side walls 32 of the printing machine.

The arrangement operates as follows: The chain wheel 6, driven by the chain 35, is turning in the direction of rotation of the ductor cylinder 1 and takes along the first pawl 7 and the second pawl 9. The torsion spring 8 acts on the pawls 7 and 9 causing the thumb 41 of the first pawl 7 to bear on the working surface of the stable cam 4. As the largest radius of the stable cam 4 is larger than the radius of the first ratchet wheel 5 and of the second ratchet wheel 10, the pawls 7, 9 do not engage into the teeth of the ratchet wheels 5, 10. In the course of turning of the chain wheel 6 the pawls 7 and 9 follow the shape of the stable pawl 4. In the lowest point of the stable cam 4 the first pawl 7 starts to take along the first ratchet wheel 5 and thus also the ductor cylinder 1. The second pawl 9 starts at the same moment to take along the second ratchet wheel 10, whereby the roller 33 on the first control lever 15 rolls along the cam track 40 on the hub of the second ratchet wheel 10. The second ratchet wheel 10 and the ductor cylinder 1 are taken along until the thumb 41 of the first ratchet wheel 7 enters the higher part of the stable cam 4. In this position the pawls 7, 9 come out of engagement with the ratchet wheels 5, 10.

The magnitude of turning of the first ratchet wheel 5 and of the second ratchet wheel 10 can be adjusted by turning the adjustable cam 3. The adjustable cam 3 is rotatably supported on the supporting sleeve 22 and has the same circumferential shape as the stable cam 4. The adjustable cam 3 has a detent 39 meshing by way of a toothed intermediate wheel 19 with a toothed control wheel 20 provided with a control lever 21. The turning of the adjustable cam 3 is accomplished manually by means of a control lever 21. The adjustable cam 3 covers according to the angle of turning by its part with a larger radius the released part of the sleeve cam 4. In case of a maximum turning of the adjustable cam 3 this cam 3 covers by its part with a larger radius the whole released part of the stable cam 4, whereby the thumb 41 of the first pawl 7 slides along the larger radius of the adjustable cam 3 and of the stable cam 4. In this position the first pawl 7 is out of engagement with the first ratchet wheel 5 and equally the second pawl 9 is out of engagement with the second ratchet wheel 10 so that the ductor cylinder 1 is not turning. In case of a minimum turning of the adjustable cam 3 the whole released part of the stable cam 4 is uncovered. In this position the thumb 41 of the first pawl 7 can follow also the smaller radius of the adjustable cam 3 and of the stable cam 4. Thus the first pawl 7 comes in engagement with the first ratchet wheel 5 and the second pawl 9 with the second ratchet wheel 10 and thus also a maximum turning of the ductor cylinder 1 and of the second ratchet wheel 10 is accomplished. In case of a turning of the second ratchet wheel 10, the roller 33 follows the cam track 40 of the second ratchet wheel 10. At the moment where the ductor cylinder 1 starts turning, the second ratchet wheel equally starts turning, whereby the roller leaves the depressed part of the cam track 40 and takes a position on the cylindrical part of the cam track 40.

When the roller 33 changes its position, the first control lever 15 is deviated, deviating over the rod 17 also the second control lever 24, firmly connected with the supporting rod 25. The supporting rod 25 is thereby deviated and causes by means of the holder 26 the transfer cylinder 2 to come in contact with the ductor cylinder 1. The time interval of mutual rolling contact of the ductor cylinder 1 with the transfer cylinder 2 lasts during the whole time the ductor cylinder 1 and the second ratchet wheel 10 are turning. This rolling contact of both said cylinders is only interrupted when the thumb 41 of the first pawl 7 starts to follow the larger radius of cam 4, whereby the first pawl 7 ceases to engage with the first ratchet wheel 5 and the second pawl 9 with the second ratchet wheel 10. As soon as the ductor cylinder 1 ceases to turn, the second ratchet wheel 10 is returned by the first pull spring 11 into its starting position. The roller 33 takes a position on the released part of the cam track 40 of the second ratchet wheel 10. The transfer cylinder 2 is in this position brought by means of the return lever 28 and the second pull spring 29 in contact with the inking cylinder 30.

I claim:

1. Arrangement for generating a rocking motion of a transfer cylinder of an inking system derived from an intermittent motion of a ductor cylinder, in a printing machine, comprising a transfer cylinder with a shaft, a supporting rod pivotably supported in a side wall of the printing machine, holders fixed on this supporting rod rotatably supporting the transfer cylinder, a ductor cylinder on a shaft, a chain wheel rotatably supported on the ductor cylinder shaft, a connecting bolt rotatably supported on this chain wheel, a first pawl and a second pawl fixed on this connecting bolt, a thumb provided on the first pawl, a stable first cam fixed on the shaft of the ductor cylinder, a supporting sleeve with an adjustable second cam rotatably supported on the shaft of the ductor cylinder, the thumb on the first pawl adapted to bear alternately on the working surface of the first and second cam, a first ratchet wheel fixed on the shaft of the ductor cylinder, the first pawl adapted for selective engagement with this first ratchet wheel, a second ratchet wheel rotatably supported on the shaft of the ductor cylinder, the second pawl adapted for selective engagement with this second ratchet wheel, a cam track provided on the hub of the second ratchet wheel, a stable supporting bolt rockingly supporting a first control lever, a roller rotatably arranged on this first control lever, this roller bearing against the cam track on the hub of the second ratchet wheel.

2. Arrangement as in claim 1 comprising a second control lever fixed on the supporting rod with the holder rotatably supporting the transfer cylinder, this second control lever connected by connecting bolts and by a rod with the first control lever, a spring loaded return lever fixed furthermore on this supporting bolt.

3. Arrangement as in claim 1 further comprising a stop bolt fixed on the hub of the second ratchet wheel, a spring loaded stop arranged on the side wall of the printing machine cooperating with said stop bolt, a first pull spring fixed with one end on the hub of the second ratchet wheel and with its second end on the side wall of the printing machine.

4. Arrangement as in claim 1, wherein said first pawl contacts said first ratchet wheel in response to coming in contact with a relatively small radial portion of the working surface of said first and second cam, and wherein said second pawl is connected to said first pawl and contacts said second ratchet wheel in synchronism with the contact between said first pawl and said first ratchet wheel.

* * * * *

UNITED STATES PATENT OFFICE
CERTIFICATE OF CORRECTION

Patent No. 4,050,383 Dated September 27, 1977

Inventor(s) Karel Hynšt

It is certified that error appears in the above-identified patent and that said Letters Patent are hereby corrected as shown below:

Column 3, line 66: "sleeve" should be --stable--.

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*